United States Patent [19]

Svensson et al.

[11] 3,956,435

[45] May 11, 1976

[54] FLOW GRATE STRUCTURE FOR COOLING TOWERS

[75] Inventors: Günther Svensson, Bochum; Hans-Joachim Wöhler, Bochum-Dahlhausen, both of Germany

[73] Assignee: Balcke-Dürr Aktiengesellschaft, Ratingen, Germany

[22] Filed: Oct. 9, 1974

[21] Appl. No.: 513,409

[30] Foreign Application Priority Data

Oct. 9, 1973 Germany ..... 2350601

[52] U.S. Cl. ..... 261/111; 261/112

[51] Int. Cl.[2] ..... F28G 1/02; F28F 25/08

[58] Field of Search ..... 261/112, DIG. 11, 111

[56] References Cited

UNITED STATES PATENTS

| | | | |
|---|---|---|---|
| 2,695,773 | 11/1954 | McGrath | 261/DIG. 11 |
| 3,039,749 | 6/1962 | Kohl et al. | 261/112 |
| 3,189,335 | 6/1965 | Fuller et al. | 261/112 |
| 3,227,429 | 1/1966 | Renzi | 261/112 |

*Primary Examiner*—Tim R. Miles
*Assistant Examiner*—Gregory N. Clements
*Attorney, Agent, or Firm*—Joseph A. Geiger

[57] ABSTRACT

A flow grate structure for cooling installations in cooling towers in which several identical square grate units are vertically aligned in a stack, but so oriented, that their offset cell fields and splash plates are staggered in a regular pattern, in which the splash plates cover, in their vertical projection, a major portion of the flow cross section of the grate unit stack.

8 Claims, 7 Drawing Figures

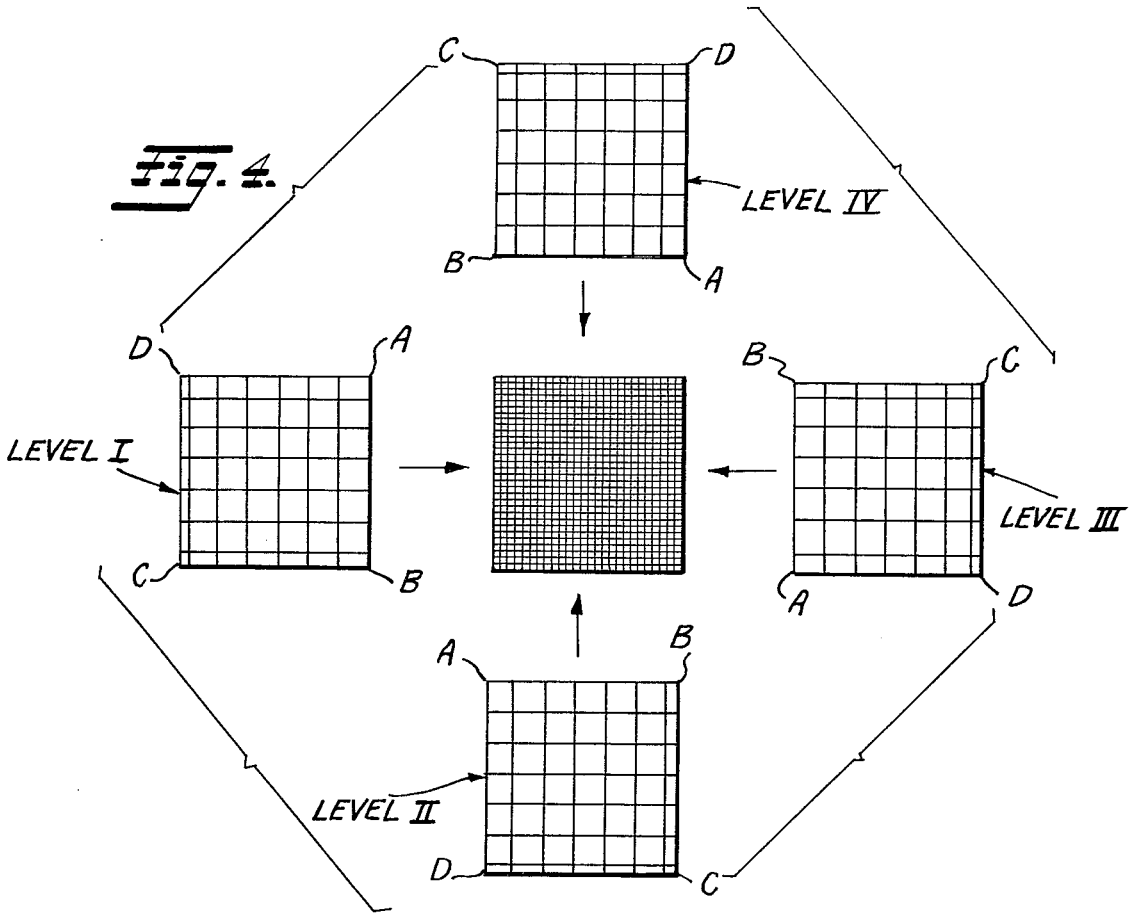
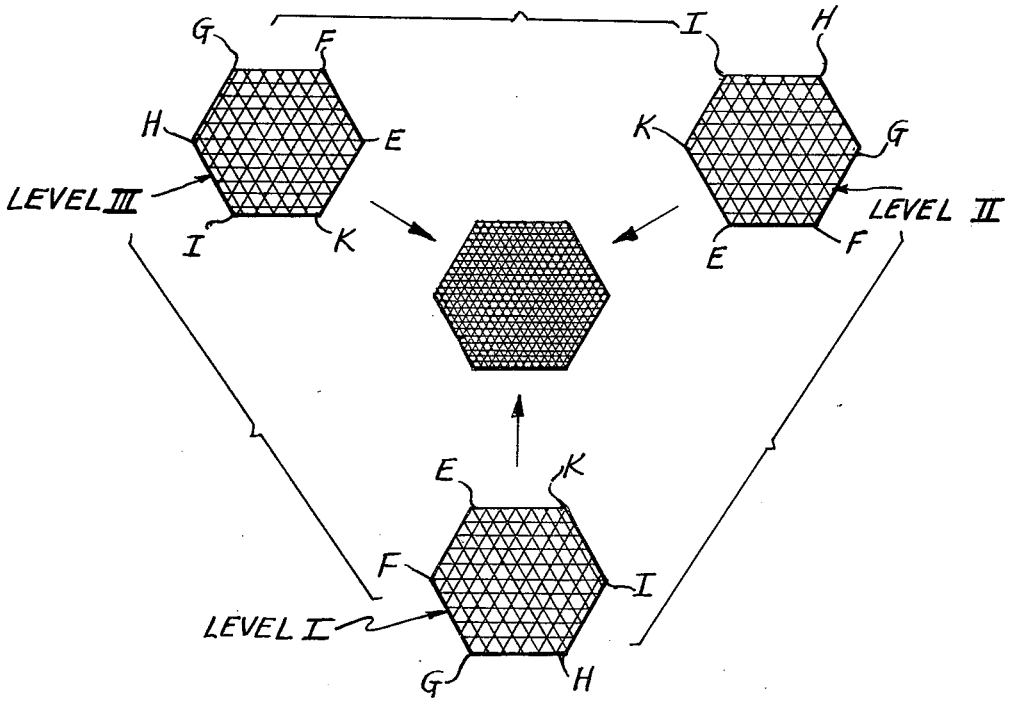
Fig. 7.

FLOW GRATE STRUCTURE FOR COOLING TOWERS

BACKGROUND OF THE INVENTION

1. Field of the Invention

The present invention relates to water cooling towers, and in particular to flow grate structures erected inside cooling towers for the transfer of heat from hot cooling water to a flow of air.

2. Description of the Prior Art

Among flow grate structures for cooling towers known from the prior art is one disclosed in the German Allowed Application (Auslegeschrift) No. 1,276,061 which features a cooling installation composed of a plurality of grate units having upright webs, preferably of plastic material, intersecting each other to form cells or fields, preferably square in outline. A complete cooling installation thus consists of a large number of grate units arranged in successive superposed layers, with an intermediate gap, if desired, so as to form cascade-type flow passages for the hot cooling water.

Each grate unit thus defines a number of cells which are open on both ends, the water flowing downward between the webs constituting the cell walls. The aforementioned known installation features superposed grate units where vertically adjacent units are longitudinally offset by one-half of the cell width, in order to create as much as possible a cascading and splashing effect of the falling water drops. However, the longitudinal offset between successive layers of grate units brings with it a certain difficulty, inasmuch as the outer end walls of the grate units are no longer vertically aligned, and the spacer elements between the various layers must be laterally offset accordingly.

SUMMARY OF THE INVENTION

Underlying the present invention is the objective of providing an improved grate unit of the above-described type for use in cooling installations inside cooling towers, such as installation being preferably composed of a plurality of identical grate units of which the combined splash plate surfaces of several —preferably four — successive layers completely cover, in their vertical projection, the effective cross-sectional area of the cooling installation through which the water cascades vertically from top to bottom of the installation. An additional objective aimed at by the present invention is a grate unit having border fields which are so designed that, inspite of a lateral offset between successive grate units, the edges of successive units are in vertical alignment with one another.

The present invention proposes to attain the above objectives by suggesting a novel grate unit which is so constructed that its vertical webs define a number of identical cell fields covering one or more larger fields (core field), preferably of square outline, the core field being surrounded by additional fields (border fields) within the overall rectangular outline of a grate unit, the outermost webs which define the outline of the grate unit having such a distance from the webs which define the outline of the core field that the sum of these distances measured on opposite border fields is 5/4 of the side length of a cell field, the two border fields arranged opposite each other in one axis having a width of 1/4 and 414, respectively, while the two border fields arranged in the transverse axis have a width of 3/4 and 2/4, respectively. The grate unit further includes splash plates on its upper side, above the web intersections.

In a preferred embodiment, the invention further suggests that the splash plates are likewise square in outline, but arranged in diagonal alignment with the webs, the side length of the splash plates being preferably equal to, or slightly less than, one-half of the distance between adjacent webs.

A modified embodiment of the invention features a composite grate unit of rectangular outline, assembled from two square grate units in such a way that the sum of the widths of those border fields which are located on the short sides of the rectangle is again 4/5 of the side length of a cell field, whereby the two outside webs of the constituent square units, along which the latter are joined, are omitted.

The assembly of a cooling installation composed of a plurality of square grate units, as proposed by the invention, is preferably accomplished in such a way that successive grate units are vertically aligned along their border outline, each vertically adjacent grate unit being rotated 90° in relation to the preceding unit. This assembly pattern produces a stack of grate units in which both the webs and the splash plates of successive grate unit layers are offset in relation to each other in a unique geometric pattern. Thus, if the splash plates arranged above the web intersections and oriented as mentioned earlier, cover a surface area equal to approximately 25 percent of the total area of a grate unit, an assembly configuration is obtainable in which four successive layers of grate units, when rotated 90° on each level, almost completely cover the entire cross-sectional flow area through the grate unit. Consequently, when water flows through such an assembly from top to bottom, it is forced to repeatedly change its flow direction, being prevented from falling through more than three successive grate levels, thereby producing an optimal agitation and distribution of the cascading water, which thus results in an accordingly improved heat transfer efficiency between the hot water and the upwardly counterflowing air. The latter, obviously, is likewise forced to repeatedly change its flow direction, as it rises through the stacks of grate units in the cooling installation.

Manufacture and assembly of these novel grate units, when compared to known prior art alternatives, is greatly simplified, affording substantial economies in time and cost. It should be understood that a stack of grate units may be assembled either by placing each unit directly on top of a preceding unit, in which case a very compact stack is obtained, or by vertically spacing successive grate units with the aid of suitable spacer elements, in a manner similar to prior art installations. The grate units may be mounted either in a supported mode, or in a suspended mode.

The invention is analogously embodiable in a grate unit having regular triangular cells, inside a base frame of triangular outline, six such base frames being joined to form a composite grate unit of hexagonal outline.

BRIEF DESCRITION OF THE DRAWINGS

Further special features and advantages of the invention will become apparent from the description following below, when taken together with the accompanying drawings which illustrate, by way of example, several embodiments of the invention, represented in the various figures as follows:

FIG. 4 illustrates a mode of assembling successive grate units into a stack, as part of a cooling installation;

FIG. 7 illustrates, like FIG. 4, a mode of assembling several grate units per FIG. 6 into a stack.

DESCRIPTION OF THE PREFERRED EMBODIMENTS

Figure 1:
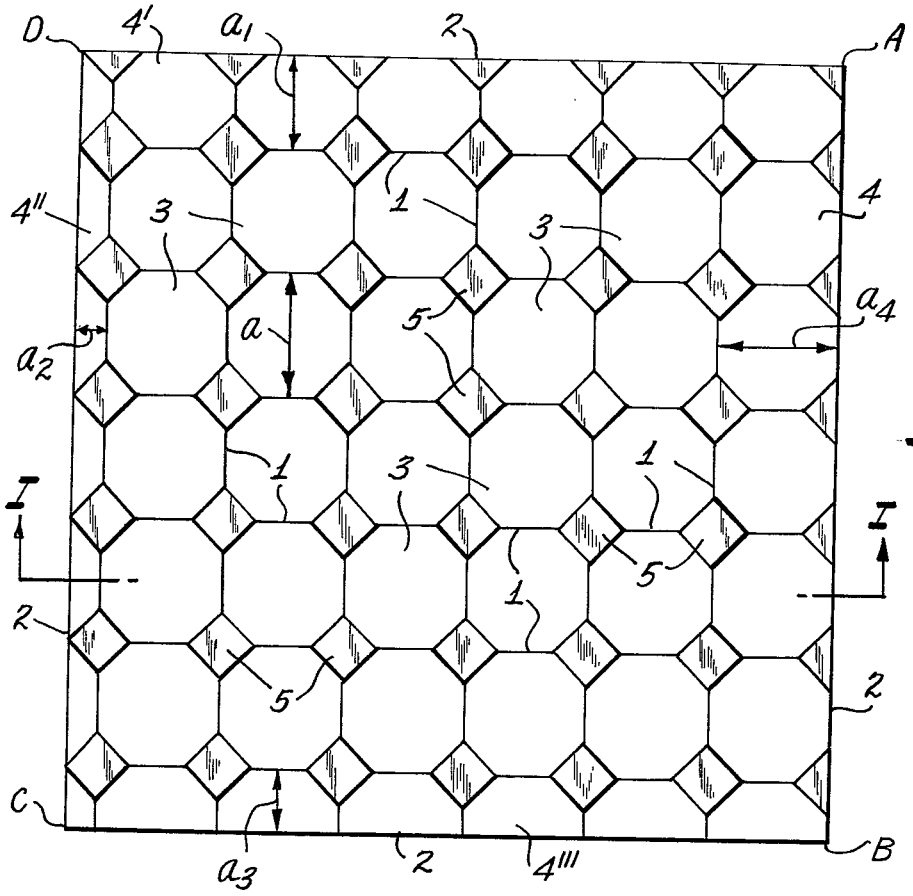
FIG. 1 is a plan view of a grate unit of square outline, representing an embodiment of the invention.

Referring to FIG. 1, there is shown a grate unit of square outline, the latter being defined by the corners A, B, C, and D. The grate unit is composed of a plurality of longitudinal and transverse webs 1 intersecting each other at right angles, and four outside webs 2 constituting the border of the unit. In the embodiment illustrated in FIG. 1, the core field of the grate unit is composed of twenty-five identical cell fields 3, four border fields 4, 4', 4'', and 4''' of varying width surrounding the core field.

It should be understood that the core field may consist of any other suitable number of individual cell fields, using any square integer (e.g. 1, 4, 9, 16, etc.). The cell fields 3, which together constitute a square core field, may, of course, also have the outline of a rectangle or of some other polygon.

Figure 2:
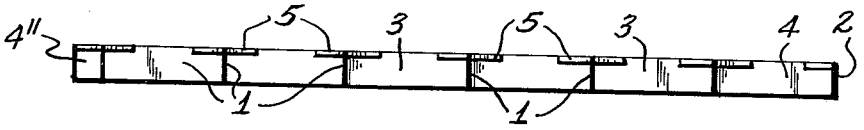
FIG. 2 shows a cross section along line I—I of the grate unit of FIG. 1.

At each web intersection is further arranged a square splash plate 5, the size of which is such that the total splash surface equals approximately 25 percent of the surface covered by the cell fields 3. These splash plates 5 are rotated 45° in relation to the orientation of the webs 1, so that the latter are in alignment with the diagonals of the splash plates. As can be seen in FIG. 2, the splash plates are arranged above the webs 1.

The novel grate units feature, as an important improvement over the prior art, four differently dimensioned border fields 4, 4', 4'', and 4''', in a unique arrangement: The width $a_1$ of the border field 4', as measured between the outside web extending from corner D to corner A and the nearest web 1 of the core field, equals 3/4 of the side length $a$ of a cell field 3 of the grate unit, while the width $a_3$ of the opposite border field 4''', as measured between the outside web 2 extending from corner C to corner B and the nearest web 1, equals 2/4 of the length $a$. In contrast thereto, the width $a_2$ of the border field 4'', between the outside web 2 extending from corner D to corner C and the nearest web 1, equals 1/4, and the corresponding width $a_4$ of the border field 4 equals 4/4 of the side length $a$, meaning that the width of the border field 4 is identical to the basic width of a cell field 3. Consequently, it can be said that the sum of the widths of two oppositely arranged border fields is equal to 5/4 of the side length $a$ of a cell field of the grate unit.

In FIG. 4 is schematically illustrated an assembly mode showing how a unique stack of grate units can be obtained, when four of the units shown in FIG. 1 are placed on top of each other. This assembly mode provides that each grate unit, before being placed on the stack, is rotated 90° in relation to the preceding grate unit, so that, when the stack of four units is seen from above, a web pattern of the stack, offset in both directions as shown in the center of FIG. 4, is obtained. It will be noted that the splash plates of the grate units shown in FIG. 4 have been omitted for purposes of clarity of the drawing.

Figure 5:
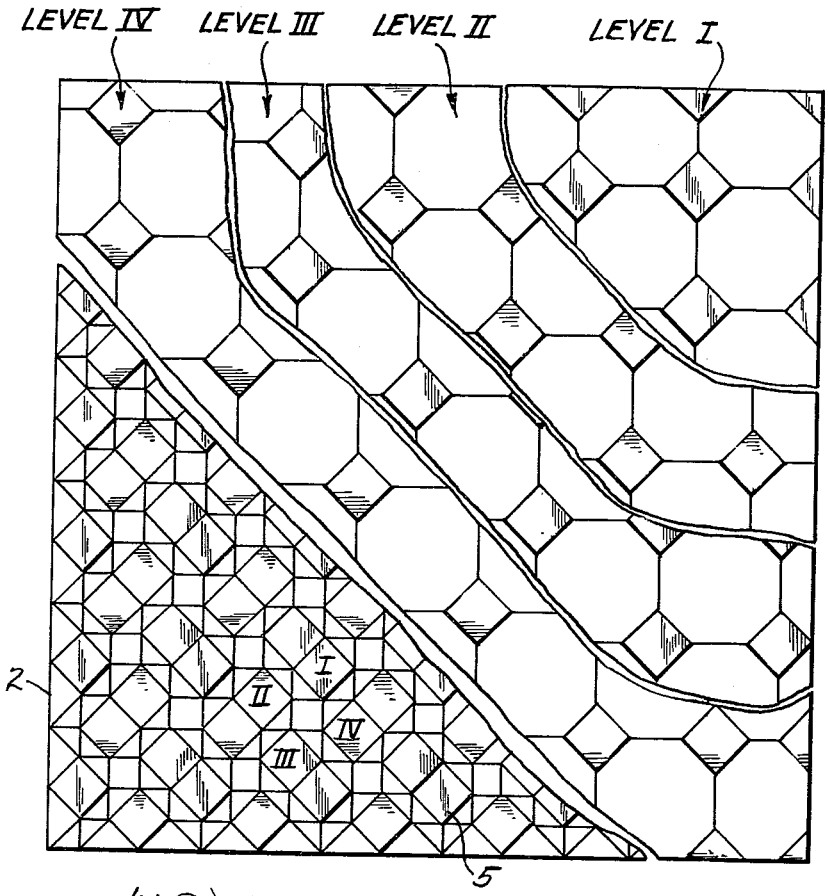
FIG. 5 shows in plan view a stack of four superposed grate units, portions of the stack being cut away.

A stack of four grate units, assembled in accordance with the assembly mode shown in FIG. 4, is illustrated in FIG. 4, as illustrated in FIG. 5. Here, it can be seen that the splash plates 5 of successive grate unit layers are arranged in an offset pattern in which there is no vertical overlap between the splash plates of successive grate units, the latter thus covering almost the entire cross-sectional flow area of the unit. For better illustration, FIG. 5 shows only a portion of a completely assembled four-unit stack, cut-away portions of the four successive layers being also shown, in order to better demonstrate the result of the proposed unique assembly pattern.

Figure 3:
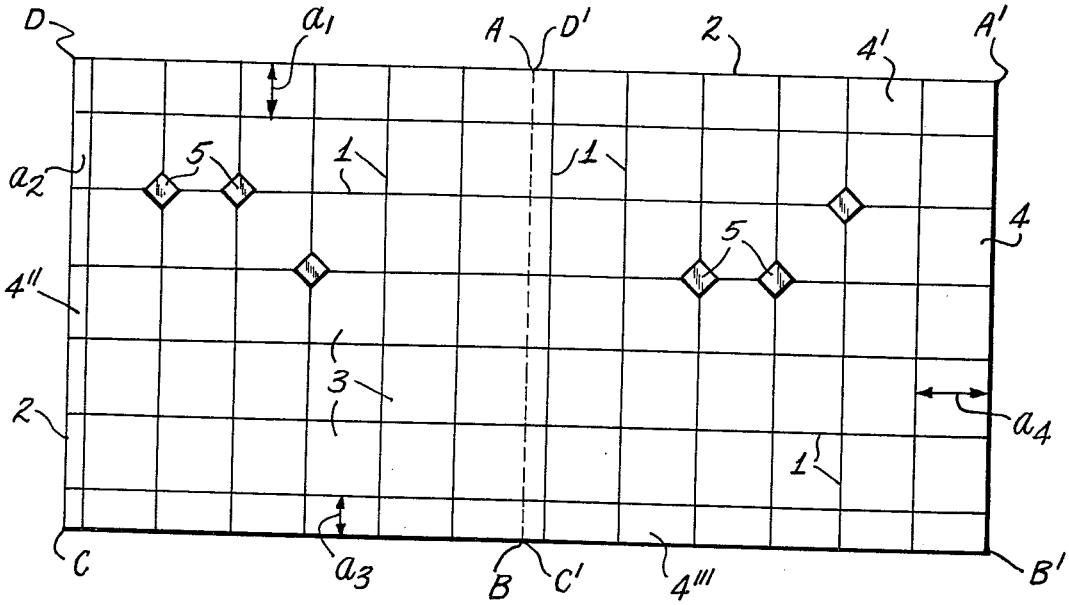
FIG. 3 is a plan view of a composite grate unit, consisting of two joined square units, in a modified embodiment of the invention.

In FIG. 3 is illustrated a modified embodiment of the invention, featuring a larger, rectangular grate unit. Here, the grate unit is composed of two constituent square grate units of the type shown and described in connection with FIG. 1. The two constituent units are again square in outline, the latter being defined by the corner points A, B, C and D of a first unit, and the corner points A', B', C' and D' of a second unit. Both units are oriented identically. In order to avoid an unnecessary multiplication of webs at the joint line A–B and D'–C', which line is shown dotted in FIG. 3, both outside webs 2 are omitted, since a third web 1 is located in the vicinity of the joint line, at a distance of 1/4 of $a$. The result is one somewhat enlarged row of cell fields, having a length of 5/4 of $a$.

Here again, the same relationships between the widths of opposite border fields obtains: for example, the sum of the border field widths $a_2$ and $a_4$ on the short sides of the rectangle is 5/4 (1/4 + 4/4).

A similar procedure is again employed for the assembly of a stack of grate units, whereby first a second rectangular unit is placed alongside the unit shown in FIG. 3, so as to obtain a larger square outline, whereupon two identical rectangular grate units are placed on top of the first level, after they have been rotated 90°. Successive levels are similarly rotated, as outlined in connection with FIG. 4.

Figure 6:
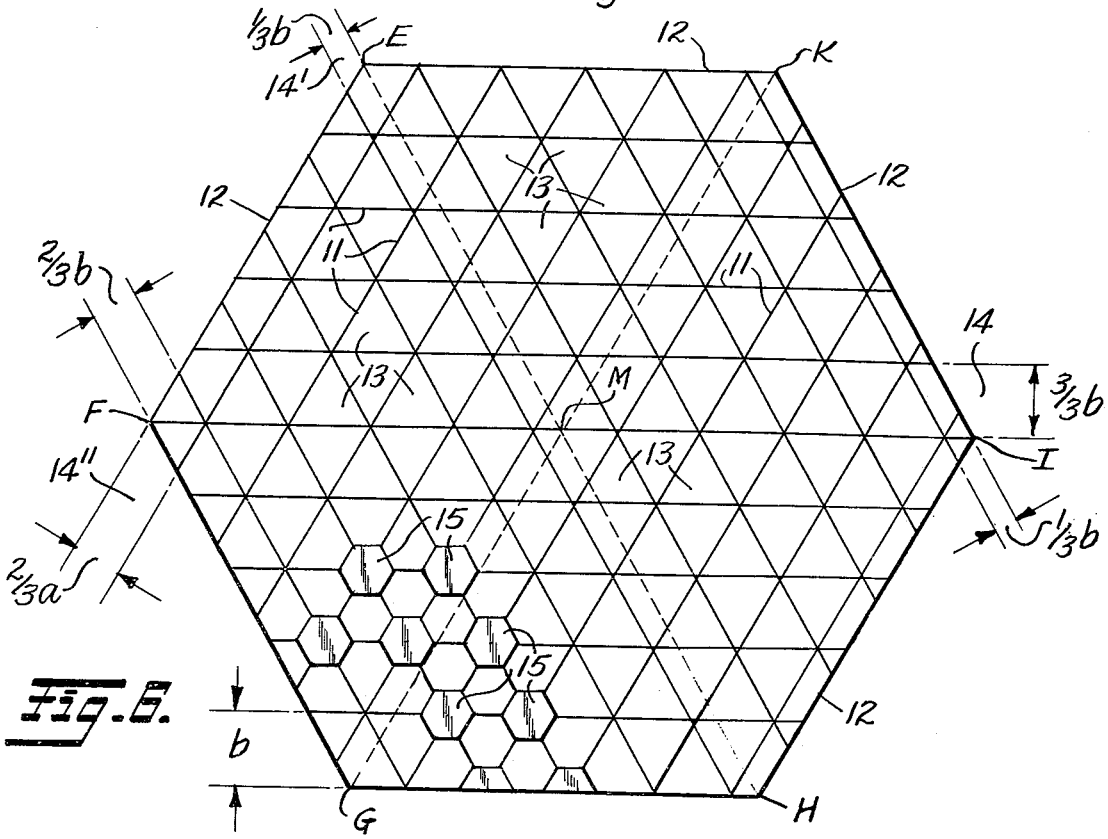
FIG. 6 is a plan view of an alternative embodiment of the invention, featuring a grate unit of triangular/hexagonal outline.

In FIG. 6 is shown a second embodiment of the invention in which the basic grate unit has a regular triangular outline that is defined, for instance, by the corner points E, F and M, six identical triangular constituent units being combined to form the composite hexagonal grate unit shown. As in the case of the composite unit of FIG. 2, the webs at the — dotted — joint lines E–M–H and K–M–G are again omitted, while only one web 12 is provided at the joint line F–M–I.

It will be noticed that, while the embodiment of FIGS. 1–5 is determined, in all its basic characteristics, by the integer 4, the embodiment of FIG. 6 substitutes for the latter the integer 3 in analogous relationships of structure. Thus, the constituent triangular unit has a triangular core field consisting of a plurality of triangular cell fields 13 — the number is again a square integer (e.g. 1, 4, 9, etc.) — the core field being surrounded by three border fields 14, 14' and 14'' of a width which is, respectively, 1/3, 2/3 and 3/3 of the width $b$ of a field cell 13.

The splash plates 15, arranged on top of the intersections of the webs 11, are preferably hexagonal and equal to, or slightly less in area than one-third the area of a field cell.

Each stack of grate units, accordingly, comprises three superposed grate units, a preferred assembly mode being illustrated in FIG. 7. As can readily be ascertained through a comparison with FIG. 4, the analogy between the two embodiments extends also to the assembly mode, so that the explanations given above with respect to FIGS. 4 and 5 apply also to this embodiment, when adapted analogously.

It should be understood, of course, that the foregoing disclosure describes only preferred embodiments of the invention and that it is intended to cover all changes and modifications of these examples of the invention which fall within the scope of the appended claims.

What we claim is:

1. A flow grate structure for the direct transfer of heat from a cascading flow of liquid to a counter-flowing stream of gas, adapted, for example, for use in conjunction with water cooling installations in cooling towers, the structure comprising in combination:

at least one stack consisting of four identical flat, horizontal grate units having a rectangular overall outline along which the grate units are vertically aligned; and wherein each grate unit includes a set of generally vertically oriented longitudinally extending parallel webs, and a similar set of parallel transverse webs intersecting the former so as to define a number of constituent square cell fields, open on their upper and lower sides, for a downward flow of liquid and a counter-flow of gas therethrough;

each grate unit has generally horizontally oriented splash plates arranged above the intersections of its webs;

the longitudinal and transverse webs of each grate unit define a number of said constituent cell fields which together occupy a core field of rectangular outline, located within said rectangular overall outline of the grate unit, while four rectangular border fields, enclosed by longitudinal and transverse webs, occupy the remaining area between said core field and said overall grate unit outline;

the border fields differ from each other in width, the combined width of each of the two pairs of oppositely arranged border fields being equal to 5/4 of the width of a cell field; and the four grate units in said stack are oriented each differently from the other three, at angular intervals that are multiples of 90°.

2. A flow grate structure as defined in claim 1, wherein the splash plates of each grate unit are square in outline, having a side length approximately equal to one-half of the width of a cell field and arranged with their two diagonals substantially in vertical alignment with the webs of the grate unit.

3. A flow grate structure as defined in claim 1, wherein:

the overall outline of the grate unit and the outline of the core field are squares;

the number of cell fields in the core field is a square integer (1, 4, 9, etc.); and the widths of the four border fields is 1/4 and 4/4 of the width of a cell field on one pair of opposite sides of the square, and 2/4 and 3/4 of the width of a cell field on the other pair of opposite sides.

4. A flow grate structure as defined in claim 1, wherein at each level of a four-unit stack, two grate units of square overall outline are horizontally joined along the length of one of their sides, so as to constitute a composite unit of rectangular outline having a pair of short border fields and another pair of long border fields, the two constituent grate units being so oriented that the combined width of each pair of border fields is again 5/4 of the width of a cell field.

5. A flow grate structure as defined in claim 4, wherein:

the two constituent grate units are joined along their sides at which the widths of their border fields are 1/4 and 4/4, respectively; and said two border fields are merged across their line of junction so as to define enlarged junction cell fields having a width equal to 5/4 of the width of a cell field.

6. A flow grate structure for the direct transfer of heat from a cascading flow of liquid to a counter-flowing stream of gas, adapted, for example, for use in conjunction with water cooling installations in cooling towers, the structure comprising in combination:

at least one stack of three identical flat, horizontal grate units having a hexagonal overall outline along which they are vertically aligned; and wherein each grate unit includes three sets of generally vertically oriented parallel webs intersecting each other so as to define a number of regular triangular cell fields, which fields are open on their upper and lower sides for a downward flow of liquid and a counter-flow of gas therethrough;

each grate unit has generally horizontally oriented splash plates arranged above the intersections of its webs;

the intersecting sets of webs of each grate unit define a number of cell fields which together occupy a core field area of hexagonal outline, located within said hexagonal overall outline of the grate unit, while six border fields occupy the remaining area between said core field and said overall grate unit outline; and the combined width of each of the three pairs of oppositely arranged border fields is equal to a simple multiple of the width of a cell field.

7. A flow grate structure as defined in claim 6, wherein the splash plates of each grate unit are hexagonal in outline, having a surface area approximately equal to one-half of the area of a cell field.

8. A flow grate structure as defined in claim 6, wherein the three grate units in a stack, while vertically aligned, are oriented each differently from the other two, at angular intervals that are multiples of 120°.

* * * * *